US012168816B2

(12) United States Patent
Garland et al.

(10) Patent No.: US 12,168,816 B2
(45) Date of Patent: Dec. 17, 2024

(54) WEAR RESISTANT MINING FE ALLOY MATRIX AND SPINEL CERAMIC COMPOUND COMPOSITE

(71) Applicant: ME Global Inc., Minneapolis, MN (US)

(72) Inventors: Aaron James Garland, Columbia Heights, MN (US); Joaquin Aguilar Santillan, Gilbert, AZ (US); Antony Pieter, Chandler, AZ (US); Shayne Allen Berns, Mesa, AZ (US); Mark Dexter Hines, San Tan Valley, AZ (US); Ricardo Rodrigo Leiva Illanes, Rancagua (CL); Benjamin Zimmerman, Tempe, AZ (US); Daniel William Ruffelle, New Brighton, MN (US)

(73) Assignee: ME GLOBAL INC., Minneapolis, MN (US)

( * ) Notice: Subject to any disclaimer, the term of this patent is extended or adjusted under 35 U.S.C. 154(b) by 0 days.

(21) Appl. No.: 18/255,599

(22) PCT Filed: Dec. 3, 2021

(86) PCT No.: PCT/US2021/061771
§ 371 (c)(1),
(2) Date: Jun. 2, 2023

(87) PCT Pub. No.: WO2022/120148
PCT Pub. Date: Jun. 9, 2022

(65) Prior Publication Data

US 2024/0102132 A1 Mar. 28, 2024

Related U.S. Application Data

(60) Provisional application No. 63/121,449, filed on Dec. 4, 2020.

(51) Int. Cl.
*B22D 19/00* (2006.01)
*B22D 19/02* (2006.01)
(Continued)

(52) U.S. Cl.
CPC ..... *C22C 1/1068* (2013.01); *B22D 19/00* (2013.01); *B22D 19/0081* (2013.01);
(Continued)

(58) Field of Classification Search
CPC ..... B22D 19/00; B22D 19/02; B22D 19/04; B22D 19/06; B22D 19/14
See application file for complete search history.

(56) References Cited

FOREIGN PATENT DOCUMENTS

EP 0670441 A1 * 9/1995 ..... B22D 19/08
EP 2435636 A1 4/2012
(Continued)

OTHER PUBLICATIONS

International Search Report for International Patent Application No. PCT/US2021/061771 mailed Mar. 18, 2022.

*Primary Examiner* — Kevin E Yoon
(74) *Attorney, Agent, or Firm* — Merchant & Gould P.C.; Daniel R. Evans

(57) ABSTRACT

A metal matrix composite to high tolerate wear as a property has been produced by infiltration casting of a Fe Alloy and a spinel ceramic by using a material design for i) metal transport phenomena conditions, ii) predefined wetting and capillarity and iii) processing child insert/mother casting methodology to produce a final casting in shape and form to meet the needs of a mining end user.

13 Claims, 3 Drawing Sheets

(51) Int. Cl.

| | |
|---|---|
| ***B22D 19/14*** | (2006.01) |
| ***C22C 1/10*** | (2023.01) |
| ***C22C 29/00*** | (2006.01) |
| ***C22C 29/12*** | (2006.01) |
| ***C22C 33/00*** | (2006.01) |

(52) U.S. Cl.

CPC ..... *B22D 19/02* (2013.01); *B22D 19/14* (2013.01); *C22C 1/1047* (2023.01); *C22C 29/005* (2013.01); *C22C 29/12* (2013.01); *C22C 33/00* (2013.01); *C22C 33/006* (2013.01)

(56) References Cited

FOREIGN PATENT DOCUMENTS

| | | | | |
|---|---|---|---|---|
| WO | 2010136055 | A1 | 12/2010 | |
| WO | WO-2010136208 | A1 * | 12/2010 | ..... B22D 19/06 |

* cited by examiner

WEAR RESISTANT MINING FE ALLOY MATRIX AND SPINEL CERAMIC COMPOUND COMPOSITE

RELATED APPLICATIONS

This application is a National Stage Application of PCT/US2021/061771, filed on Dec. 3, 2021, which claims the benefit of and priority to U.S. Provisional Patent Application No. 63/121,449, filed on Dec. 4, 2020, the subject matter of which are incorporated by reference in their entireties. To the extent appropriate, a claim of priority is made to each of the above disclosed applications.

SUBJECT OF THE INVENTION

The present invention relates to a metal matrix composite by metal infiltration casting and consisting of a Fe alloy metal matrix and a Spinel oxide ceramic material.

BACKGROUND

A focus of the disclosure is obtaining an understanding of composite processing and properties (e.g., mechanical, physical, and thermal) as controlled by their structure at micro- and macro-levels. This involves a knowledge of the properties of the individual constituents that form the composite system, the role of high temperature wetting and interface between the components, the consequences of joining together, say, a particle (s) oxide and matrix material to form a unit composite, and the consequences of joining together these unit composites as inserts to a macro composite, a macroscopic engineering component as per some optimum engineering specifications. We focus on structure-property correlations at various levels with processing conditions that help us produce the composites.

Metals are truly engineering materials. They are strong and tough. They can be plastically deformed, and they can be strengthened by a wide variety of methods, mostly involving obstruction of movement of lineal defects called dislocations. An easy way of strengthening Fe (Steel, iron) metals by impeding dislocation motion is that of introducing heterogeneities such as solute atoms or precipitates or hard particles in a ductile matrix.

Oxide dispersion strengthening involves artificially dispersing rather small volume fractions (0.2-40 vol. %) of strong and inert oxide particles (e.g., $MgAl_2O_4$, $MgAl_2O_7$, $Al_2O_3$, $Y_2O_3$, and $ThO_2$) in a ductile matrix by internal oxidation or powder metallurgy blending techniques. [1] The ceramic dispersions act as barriers to dislocation motion in the ductile matrix, thus making the matrix more deformation resistant.

Dispersion hardened systems (e.g., $Fe+Al_2O_3$) show high strength levels at elevated temperatures while precipitates (e.g., $FeAl_2$ in steel) tend to dissolve at those temperatures.

Quenching a steel to produce a martensitic phase has been a time-honored strengthening mechanism for steels. The strength of the martensite phase in steel depends on a variety of factors, the most important being the amount of carbon. The chemical composition of martensite is the same as that of the parent austenite phase from which it formed, but it is supersaturated with carbon. [2] Carbon saturation and the lattice distortion that accompanies the transformation lead to the high hardness and strength of martensite.

Another approach of obtaining enhanced mechanical performance is rapid solidification processing. [3] By cooling metals at high rates, 104 to 109 K/s, it is possible to produce unique microstructures. Very fine powders or ribbons of rapidly solidified materials are processed into bulk materials by hot pressing, hot isostatic pressing, or hot extrusion. The rapidly solidified materials can be amorphous (non-crystalline), nanocrystalline (grain size in the nm range), or micro-dendritic solid solutions containing solute concentrations vastly superior to those of conventionally processed materials. Effectively, massive second-phase particles are eliminated. These unique microstructures lead to very favorable mechanical properties.

Ceramic materials are very hard and brittle. Generally, they consist of one or more metals combined with a non-metal such as oxygen, carbon, or nitrogen. They have strong covalent and ionic bonds and very few slip systems available compared to metals. Thus, characteristically, ceramics have low failure strains and low toughness or fracture energies. In addition to being brittle, they lack uniformity in properties, have low thermal and mechanical shock resistance, and have low tensile strength. On the other hand, ceramic materials have very high elastic moduli, low densities, and can withstand very high temperatures. The last item is very important and is the real driving force behind the effort to produce tough ceramics. Consider the fact that metallic superalloys, used in jet engines, can easily withstand temperatures up to 800° C. and can go up to 1,100° C. with oxidation-resistant coatings. Beyond this temperature, one must use ceramic materials if they are available with the requisite toughness.

By far, the major disadvantage of ceramics is their extreme brittleness. Even the minutest of surface flaws (scratches or nicks) or internal flaws (inclusions, pores, or microcracks) can have disastrous results.

Crystalline ceramics generally exhibit close-packed cubic and hexagonal closest packed (hcp) structures. Spinel (Mg, Fe, Zr, Zn, Ca, Co, Ni, Zn, Ba, Ti, Li)x-n(Al,Cr)x-mOx-y. crystallizes in the isometric system; common crystal forms are octahedra, usually twinned. It has an imperfect octahedral cleavage and a conchoidal fracture. Its hardness is 8, its specific gravity is 3.5-4.1, and it is transparent to opaque with a vitreous to dull luster.

Interface formation is between a reinforcement and a matrix as the bounding surface between the two, across which a discontinuity in some parameter occurs. The discontinuity across the interface may be sharp or gradual. Mathematically, interface is a bi-dimensional region. In practice, an interfacial region has a finite thickness. In any event, an interface is the region through which material parameters, such as concentration of an element, crystal structure, atomic registry, elastic modulus, density, coefficient of thermal expansion, etc., change from one side to another. Clearly, a given interface may involve one or more of these items. The behavior of a composite material is a result of the combined behavior of the following three entities: i) Ceramic or the reinforcing element, ii) Matrix, iii) Ceramic/matrix interface.

The reason the interface in a composite is of great importance is that the internal surface area occupied by the interface is quite extensive. It can easily go as high as 3,000 $cm^2/cm^3$ in a composite containing a reasonable ceramic volume fraction.

Various mechanisms can assist or impede adhesion. [4] A key concept in this regard is that of wettability. Wettability is a measure of the ability of a liquid to spread on a solid surface. Measurement of the wettability of a given solid by a liquid by considering the equilibrium of forces in a system consisting of a sessile drop of liquid resting on a plane solid surface in the appropriate atmosphere. The liquid drop will spread and wet the surface only if this results in a net reduction of free energy of the system. Note that a portion of the solid/vapor interface is substituted by the solid/liquid interface. Contact angle, θ, of a liquid on the solid surface fiber is a convenient and important parameter to characterize wettability. Commonly, the contact angle is measured by putting a sessile drop of the liquid on the flat surface of a solid substrate. The contact angle is obtained from the tangents along three interfaces: solid/liquid, liquid/vapor, and solid/vapor. The contact angle, θ can be measured directly by a goniometer or calculated by using simple trigonometric relationships involving drop dimensions. In theory, one can use the following expression, called Young's equation, obtained by resolving forces horizontally $$\gamma_{SV}=\gamma_{LS}+\gamma_{LV}\cos\theta$$

where γ is the specific surface energy, and the subscripts SV, LS, and LV represent solid/vapor, liquid/solid, and liquid/vapor interfaces, respectively.

In the earlier discussion, it is implicitly assumed that the substrate is perfectly smooth. This, however, is far from true in practice. In certain instances, the interface between ceramic and metal matrix is rather rough instead of the ideal planar interface. Most ceramics or reinforcements show some degree of roughness. Surface roughness profiles of the fiber surface obtained by atomic force microscopy (AFM) can provide detailed, quantitative information on the surface morphology and roughness of the fibers. Accordingly, AFM may be a useful tool in characterizing the surface roughness. [5,6,7]

Most of the physical, chemical, and mechanical discontinuities at the interface mentioned previously are self-explanatory. The concept of atomic registry or the crystallographic nature of an interface needs some elaboration. In terms of the types we can have a coherent, semi-coherent, or incoherent interface. A coherent interface is one where atoms at the interface form part of both the crystal lattices; that is, there exists a one-to-one correspondence between lattice planes on the two sides of the interface. A coherent interface thus has some coherency strains associated with it because of the straining of the lattice planes in the two phases to provide the continuity at the interface to atomic sites on the two sides of the interface.

In general, a perfect atomic registry does not occur between unconstrained crystals. Rather, coherency at the interface invariably involves an elastic deformation of the crystals.

It is important to control the degree of bonding or adhesion between the matrix and the ceramic reinforcement. It is necessary to understand all the different possible bonding types, one or more of which may be acting at any given instant. We conveniently classify the important types of interfacial bonding as follows: Mechanical bonding, Physical bonding and Chemical bonding.

Simple mechanical keying or interlocking effects between two surfaces can lead to a considerable degree of bonding. Any bonding involving weak, secondary or van der Waals forces, dipolar interactions, and hydrogen bonding can be classified as physical bonding. The bond energy in such physical bonding is very low, approximately 8-16 kJ/mol.

Atomic or molecular transport, by diffusional processes, is involved in chemical bonding. Solid solution and compound formation may occur at the interface, resulting in a ceramic reinforcement/matrix interfacial reaction zone having a certain thickness. This encompasses all types of covalent, ionic, and metallic bonding. Chemical bonding involves primary forces and the bond energy is in the range of approximately 40-400 kJ/mol. In this regard, there are two main types chemical bonding:

1. Dissolution bonding. In this case, interaction between components occurs at an electronic scale. Because these interactions are of rather short range, it is important that the components come into intimate contact on an atomic scale. This implies that surfaces should be appropriately treated to remove any impurities. Any contamination of fiber surfaces, or entrapped air or gas bubbles at the interface, will hinder the required intimate contact between the components.
2. Reaction bonding. In this case, a transport of molecules, atoms, or ions occurs from one or both of the components to the reaction site, that is, the interface. This atomic transport is controlled by diffusional processes. Such a bonding can exist at a variety of interfaces, e.g., glass/polymer, metal/metal, metal/ceramic, or ceramic/ceramic.

Two general ways of obtaining an optimum interfacial bond involve treatments of ceramic or reinforcement surface or modification of matrix composition. It should be emphasized that maximizing the bond strength is not always the goal. The extreme in interfacial strength is when the interface is as strong or stronger than the higher-strength component of the composite, generally the reinforcement. In this case, of the three components—reinforcement, matrix, and interface—the interface will have the lowest strain-to-failure. The composite will fail when any cracking occurs at a weak spot along the brittle interface. Typically, in such a case, a catastrophic failure will occur, and we will have a composite with very low toughness.

An interface with an optimum interfacial bond strength will result in a composite with an enhanced toughness, but without a severe penalty on the strength parameters. Such a composite will have multiple failure sites, most likely spread over the interfacial area, which will result in a diffused or global spread of damage, rather than a very local damage.

SUMMARY

The method uses a sand casting model in 2 steps approach by using Step 1 child metal insert casting as carrier of the ceramics material by using a design fit metal flow transport phenomena-wetting platform for a casting process and Step 2 by placing the resultant child insert casting into a mother casting for specific design locations using mechanical fixing chaplets before metal pouring in the sand mold where composite properties are required by an end user.

DETAILED DESCRIPTION

Figure 1:
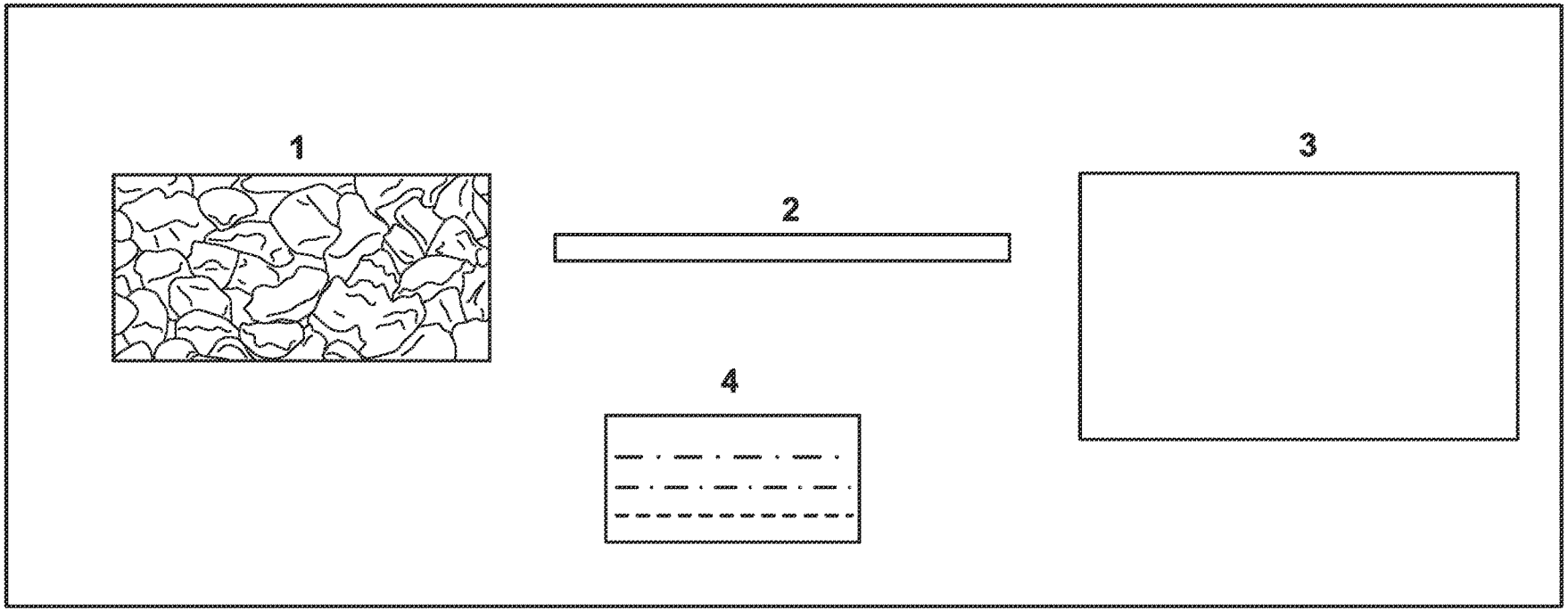
FIG. 1. Schematic of components used in process. 1) Ceramic particles, 2) Inserts representation (Child Casting), 3) Casting product representation (Mother Casting) and 4) Fe Molten Metal.
Figure 2:
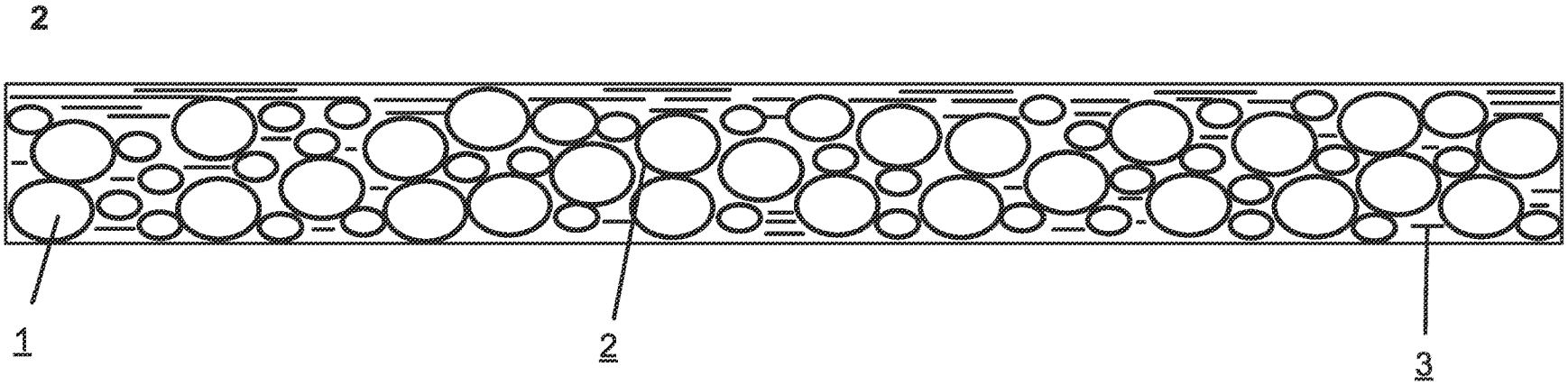
FIG. 2. Inserts (Child Casting). Where 1 represent the "loosen" ceramic particles, 2 represent the interface of ceramic-metal packaging and 3 Fe metal solidified.
Figure 3:
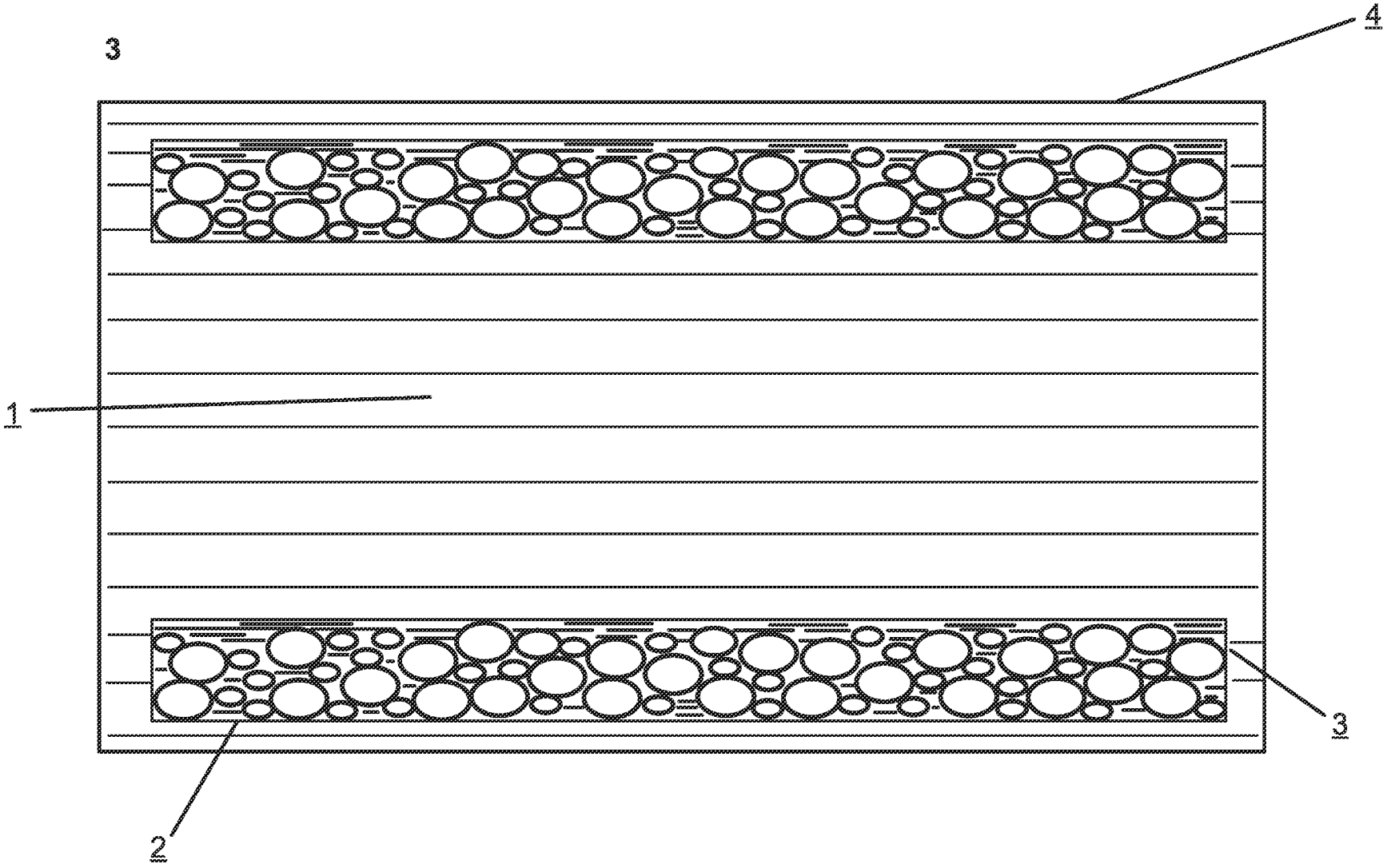
FIG. 3. Casting product representation (Mother Casting). Where 1 represent the Fe metal solidified/heat treated, 2 represent the Inserts (Child Casting), 3 represent the interface insert-mother casting (Chaplets locations) and 4 work surfaces (composite improvement).

The child metal insert consists of a metal matrix of similar characteristics of chemistry, metallurgy and physical appearance as the mother holding casting. This includes most steels (0.0-2.2% C) and irons (>2.2% C). In one aspect, the metal matrix is a Fe alloy metal with C (0.5-2.5%), Mn (0.5-1%), Cr (2-18%), Ni (0.1-2%) and Mo (0.1-1%). In another aspect, the metal matrix is a Fe alloy metal with compositional amounts (and percent eutectic carbide ("% EC") as tabulated below.

| Alloy | C | Si | Cr | Mn | Mo | S | P | % EC |
|---|---|---|---|---|---|---|---|---|
| 302 | 2.4-2.7 | 0.3-0.8 | 14.0-17.0 | 1.35-1.75 | 0.8-1.2 | ≈0.06 | ≈0.1 | 26.7 ± 3.2 |
| 306 | 2.4-2.7 | 0.3-0.8 | 14.0-17.0 | 0.5-0.8 | 2.4-2.8 | ≈0.06 | ≈0.1 | 22.0 ± 3.8 |
| SP1 | 1.5-2.65 | 0.3-0.8 | 16.0-19.0 | 0.6-0.9 | 1.0-1.4 | ≈0.06 | ≈0.1 | 22.0 ± 2.4 |
| 482 | 3.3-3.5 | 0.3-0.7 | 22.0-26.0 | 1.0-1.4 | 0.8-1.4 | ≈0.06 | ≈0.1 | 36.1 ± 2.2 |
| 540 | 2.7-3.0 | 0.3-0.7 | 25.0-29.0 | 1.0-1.4 | 0.15-0.45 | ≈0.06 | ≈0.1 | 31.2 ± 1.7 |

The ceramic materials contemplated herein comprise spinel based Spinel (Mg, Fe, Zr, Zn, Ca, Co, Ni, Zn, Ba, Ti, Li)$_{x-n}$(Al,Cr)$_{x-m}$O$_{x-y}$. All ranges of Spinel compositions including Metal A+Metal B+Oxygen are included in the present disclosure.

The Spinels are any of a class of minerals of general formulation $AB_2X_4$ which crystallize in the cubic (isometric) crystal system, with the X anions (typically chalcogens, like oxygen and sulfur) arranged in a cubic close-packed ("ccp") lattice and the cations A and B occupying some or all of the octahedral and tetrahedral sites in the lattice. [8,9] Although the charges of A and B in the prototypical spinel structure are +2 and +3, respectively (viz., $A^{2+}B^{3+}{}_2X^{2-}{}_4$), other combinations incorporating divalent, trivalent, or tetravalent cations, including magnesium, zinc, iron, manganese, aluminum, chromium, titanium, and silicon, are also contemplated. The anion is normally oxygen; when other chalcogenides constitute the anion sublattice the structure is referred to as a thiospinel.

A and B can also be the same metal with different valences, as is the case with magnetite, $Fe_3O_4$ (as $FeFe^{2+}Fe^{3+}{}_2O^{2-}{}_4$), which is the most abundant member of the spinel group. [10] Spinels are grouped in series by the B cation. Members of the spinel group include [11]: (i) an aluminum spinel (e.g., Spinel ($MgAl_2O_4$) Gahnite ($ZnAl_2O_4$), Hercynite ($FeAl_2O_4$), Galaxite ($MnAl_2O_4$), Pleonaste ($(Mg,Fe)Al_2O_4$); (ii) an iron spinel (e.g., Cuprospinel ($CuFe_2O_4$), Franklinite ($(Fe,Mn,Zn)(Fe,Mn)_2O_4$), Jacobsite ($MnFe_2O_4$), Magnesioferrite ($MgFe_2O_4$), Magnetite ($FeFe_2O_4$, where one Fe is +2 and two Fe's are +3, respectively), Trevorite ($NiFe_2O_4$), Ulvöspinel ($TiFe_2O_4$), and zinc ferrite: ($(Zn, Fe)Fe_2O_4$)); (iii) a chromium spinel (e.g., Chromite ($FeCr_2O_4$), Magnesiochromite ($MgCr_2O_4$), Zincochromite ($ZnCr_2O_4$)), (iv) a cobalt spinel (e.g., Manganesecobaltite ($Mn_{1.5}Co_{1.5}O_4$[12]; (v) a vanadium spinel (e.g., Coulsonite ($FeV_2O_4$), Magnesiocoulsonite ($MgV_2O_4$), and (vi) other mineral having a spinel structure (e.g., Ringwoodite: $(Mg,Fe)_2SiO_4$), Taaffeite ($BeMgAl_4O_8$), and Musgravite ($Be(Mg,Fe,Zn)_2Al_6O_{12}$)).

Wetting conditions of a Fe alloy metal with Spinel ceramics show case its adhesion behavior by addressing contact angles and surface tensions as function of alloy melting point (s), surface roughness values, particles sizes, crystallographic planes, grades of purity, alloy composition and thermodynamic interfaces conditions. The designed contact angles, θ, between the pair Fe alloy metal and Spinel ceramics are in wetting of θ<90° following the equilibrium of a sessile drop model.

The manufactured liner may undergo a subsequent heat treatment depending on customer requirements. Therefore, some compatibility from the viewpoint of temperature behavior. The Fe alloy metal covered uses a CTE of about $10\times10^{-6}$ (° C.)$^{-1}$ to about $21\times10^{-6}$ (° C.)$^{-1}$ and the spinel ceramics of about $6\times10^{-6}$ (° C.)$^{-1}$ to about $11\times10^{-6}$ (° C.)$^{-1}$. Alternatively expressed, the Fe alloy metal has a CTE that ranges from about 10 ppm ° C.$^{-1}$ to about 21 ppm ° C.$^{-1}$ and the spinel ceramic has a CTE that ranges from about 6 ppm ° C.$^{-1}$ to about 11 ppm ° C.$^{-1}$; where "ppm" stands for parts per million and corresponds to $10\times10^{-6}$.

In one aspect, the Fe alloy metal has a CTE (in ppm ° C.$^{-1}$) of: 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, 15.0, 15.1, 15.2, 15.3, 15.4, 15.5, 15.6, 15.7, 15.8, 15.9, 16.0, 16.1, 16.2, 16.3, 16.4, 16.5, 16.6, 16.7, 16.8, 16.9, 17.0, 17.1, 17.2, 17.3, 17.4, 17.5, 17.6, 17.7, 17.8, 17.9, 18.0, 18.1, 18.2, 18.3, 18.4, 18.5, 18.6, 18.7, 18.8, 18.9, 19.0, 19.1, 19.2, 19.3, 19.4, 19.5, 19.6, 19.7, 19.8, 19.9, 20.0, 20.1, 20.2, 20.3, 20.4, 20.5, 20.6, 20.7, 20.8, 20.9, and 21.0.

In another aspect, the spinel ceramic has a CTE (in ppm ° C.$^{-1}$) of: 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, and 11.0 The ceramic material in size range between nano, micro and mm scale are considered in this study are based on Spinel (Mg,Fe, Zr, Zn, Ca, Co, Ni, Zn, Ba, Ti, Li)$_{x-n}$(Al,Cr)$_{x-m}$O$_{x-y}$. In one aspect, the spinel ceramic particles have a size of: (i) from about 25 nm to about 150 nm, (ii) from about 50 μm to about 500 μm, (iii) from about 1 mm to about 10 mm, (iv) or a combination thereof.

Spinel may be fused (obtained from a fusion process), sintered (obtained from a sintering process), or natural crystals directly from the mine source. The ceramic particles shapes also cover spherical, non-spherical (fibers like) and irregular shape and or combination of the same. The ceramic materials can be of purity from >80% and the remaining other oxide and non-oxide compounds not exceeding the remaining from its solid solution compound. It also includes others surface conditioners for the ceramic surfaces such as special coatings (a graphene, a metal nitrate, a metal carbide), brazing, etchers, powder metal (Al, Ti, Cr, Mn, Mg, Ni, Cu, Au, Pd, Ag, Zr, Co, Fe Sn) and or layers of materials in addition to the ceramic matrix such as pretreatment of particles to add a secondary phase.

The content of spinel ceramic materials in the insert is between 5 and 60% by volume, preferably between 30 to 40% and advantageously of the order of 50%.

The Spinel ceramic particles are aggregated in granular form to the child insert of predefined dimensions and shapes. This depends of the design and the use of the mother castings predefined by an end user or by design analysis.

The invention is based on the finding the wetting conditions of Fe alloys and Spinel ceramics where contact angles are <90° and interface formations are within 1-10 nm to 50-500 μm. The Spinel ceramics are studied for compositional ranges, roughness values, crystallographic orientations in pair with Fe alloy composition and its metal flow to evaluate its wetting, adhesion and joining behavior. In one aspect, the coefficient thermal expansion (CTE) of the ceramic material has a value of about 60 to about 70% of that of Fe alloy matrix. In another aspect, the CTE of the ceramic material has a value of about 5% to about 10% of the CTE of the Fe alloy matrix. It is contemplated that a uniform distribution of CTEs may result in reducing ceramic or casting cracking.

In an aspect of the process disclosed herein, one may select a metal flow rate, inside the casting mold, in combination with wetting contact angles. It is believed that selection of a compatible metal flow rate and wetting contact angles produces a homogeneous casting that minimizes weakening effects of ceramic particles during metal casting and solidification in the final microstructure. In one aspect, the metal case flow rate ranges from about 15 in/s to about 60 in/s where most cases seeing a pair of metal-ceramic wetting angles to <90 degrees.

In another aspect of the method described herein the infiltration process comprises a single casting fill rate of about 1 $dm^3/s$ to about 2 $dm^3/s$, including all values in between, such as, for example 1.1 $dm^3/s$, 1.2 $dm^3/s$, 1.3 $dm^3/s$, 1.4 $dm^3/s$, 1.5 $dm^3/s$, 1.6 $dm^3/s$, 1.7 $dm^3/s$, 1.8 $dm^3/s$, and 1.9 $dm^3/s$.

In another aspect of the method described herein the infiltration process comprises a full system fill rate of about 3 $dm^3/s$ to about 6 $dm^3/s$, including all values in between, such as, for example 3.1 $dm^3/s$, 3.2 $dm^3/s$, 3.3 $dm^3/s$, 3.4 $dm^3/s$, 3.5 $dm^3/s$, 3.6 $dm^3/s$, 3.7 $dm^3/s$, 3.8 $dm^3/s$, 3.9 $dm^3/s$, 4.1 $dm^3/s$, 4.2 $dm^3/s$, 4.3 $dm^3/s$, 4.4 $dm^3/s$, 4.5 $dm^3/s$, 4.6 $dm^3/s$, 4.7 $dm^3/s$, 4.8 $dm^3/s$, 4.9 $dm^3/s$, 5.1 $dm^3/s$, 5.2 $dm^3/s$, 5.3 $dm^3/s$, 5.4 $dm^3/s$, 5.5 $dm^3/s$, 5.6 $dm^3/s$, 5.7 $dm^3/s$, 5.8 $dm^3/s$, and 5.9 $dm^3/s$.

In one aspect, the spinel ceramic particles have a thermal conductivity from about 20 W/mK to about 55 W/mK, a flexural strength >2500 $kg/cm^2$, and an enthalpy of formation of from about 25 kJ/mol to about 200 kJ/mol.

Example

A white iron/spinel ceramic composite blue bar was manufactured as a part of this investigation. An exemplary white iron may be a 306 alloy, as described herein. An exemplary spinel ceramic corresponds to $MgAl_2O_4$ having a ccp lattice.

Blue bar castings were obtained bottom fed with in-gates located on the drag sand mold containing a uniform distribution of loose spinel particles ($MgAl_2O_4$) at a given flow rate, see, e.g., infra. In one example the spinel particles having a size of from about 1 to about 3 mm were present at about 7.5 vol %. In other instances, blue bar castings were fed along the parting lines.

Molten metal near the in-gate wetted spinel particles in 10 mm thick layers. Large amounts of shrinkage macroporosity were identified at the in-gate near regions where wetting occurred. Macroporosity was interconnected and extended along the longitudinal axis of the blue bar at the in-gate.

X-ray EDS Hypermaps revealed no evidence of interfacial phases or metal penetration along wetted white iron/spinel particle interfaces. These interfaces were mechanical in nature where wetted particles were held in compression due to molten metal shrinkage during solidification.

Separately, thermal gradients developed in the pouring process were examined to improve probability of a sound casting being produced. Thermal gradients where determined using the Magmasoft simulation software and measured using thermal couples placed on the surface of the casting upon the completion of the filling phase. Castings had approximate dimensions of 0.31×1.26×0.08 meters in the x, y, and z directions respectively, which may alternatively be expressed in decimeters (dm) as 3.1 dm×12.6 dm×0.8 dm in the x, y, and z directions, respectively.

The average temperature of each casting surface can be seen in Tables 1 and 2. Three different gravity fed runner designs were simulated. Design 1 (D1) was fed through the short end of the castings, design 2 (D2) was fed through the risers, and design 3 (D3) being fed through a combination of the risers and the side of the casting. The difference between the opposite sides was calculated based off these averages and shown in Table 3. This temperature difference was then divided by the cross-sectional thickness in meters to determine the thermal gradient as recorded in Table 3.

TABLE 1

| | Ceramic Temperature ° C. | | | | | |
|---|---|---|---|---|---|---|
| Design | X1 | X2 | Y1 | Y2 | Z1 | Z2 |
| D1 | 1359 ± 5 | 1359 ± 5 | 1360 ± 14 | 1351 ± 9 | 1357 ± 8 | 1354 ± 8 |
| D2 | 1359 ± 5 | 1364 ± 5 | 1354 ± 8 | 1357 ± 5 | 1358 ± 9 | 1354 ± 8 |
| D3 | 1357 ± 4 | 1365 ± 5 | 1354 ± 8 | 1354 ± 8 | 1356 ± 8 | 1354 ± 8 |

TABLE 2

| | Iron Temperature ° C. | | | | | |
|---|---|---|---|---|---|---|
| | X1 | X2 | Y1 | Y2 | Z1 | Z2 |
| D1 | 1359 ± 21 | 1358 ± 18 | 1369 ± 12 | 1333 ± 8 | 1349 ± 18 | 1356 ± 12 |
| D2 | 1327 ± 11 | 1347 ± 7 | 1339 ± 9 | 1333 ± 8 | 1336 ± 12 | 1350 ± 9 |
| D3 | 1345 ± 8 | 1360 ± 5 | 1347 ± 7 | 1339 ± 8 | 1343 ± 9 | 1350 ± 10 |

TABLE 3

| | Ceramic (Alumina) Insert | | | White Iron (306 alloy) Insert | | |
|---|---|---|---|---|---|---|
| Runners | X | Y | Z | X | Y | Z |
| D1 ΔT (° C.) | 0.1 | 9.7 | 1.6 | 1.2 | 33.1 | 7.2 |
| D2 ΔT (° C.) | 4.5 | 0.4 | 2.8 | 18.8 | 6.2 | 13.6 |
| D3 ΔT (° C.) | 7.7 | 2.6 | 1.5 | 15.7 | 7.8 | 6.6 |
| D1 Thermal Gradient (° C./m) | 0.2 | 7.7 | 20.1 | 3.7 | 26.3 | 89.7 |
| D2 Thermal Gradient (° C./m) | 14.5 | 0.3 | 35.5 | 60.6 | 4.9 | 169.5 |
| D3 Thermal Gradient (° C./m) | 24.8 | 2.0 | 19.1 | 50.8 | 6.2 | 82.3 |

Magmasoft software was used to simulate the filling rate of a mold with four casting cavities and a 28660 lbs ladle, where the filling times range from about 30 s to about 38 s. Simulated fill rate was determined by dividing the total mass of the of the castings which was then divided by the total filling time. This was then converted to volume using the density of material at the pouring temperature. Current rigging includes four castings per mold however, this process could be performed a different number of castings per mold without deviating from the essence of this process. The full system fill rates range from about 3 $dm^3/s$ to about 6 $dm^3/s$, while the single casting fill rates range from about 1 $dm^3/s$ to about 2 $dm^3/s$.

The Table 3 data shows that the thermal gradient for the ceramic insert in the xy-plane to be not more than about 25° C./m, while the thermal gradient for the 306 alloy insert to be not more than about 60° C./m. In one aspect, it is contemplated that the thermal gradient (regardless of insert) is minimized in the xy-plane such that directional solidification occurs primarily in the z-direction (along the axis of the riser), which allows for final solidification in the riser(s), as opposed to the casting.

Practical Utility

The materials methodology of the manufacture process disclosed herein relates to casting liners for grinding and milling of larger size dimensions for applications of mills, crushers, shutters, containers, pumps, pipes, carriers and other special mining equipment. The manufacturing process using ceramic particles can develop composites of thin <25 mm and thicker liner sections of >25 mm by using the manufacturing methods disclosed herein.

Disclosed Aspects

Aspect 1 relates to a casting method of producing a wear resistant mining casting material, said method comprising: a sand-casting model in a two-step approach by:

(1) selecting an Fe alloy metal and a spinel ceramic having a compatible Coefficient of Thermal Expansion (CTE), a compatible wetting contact angle (WCA), or a combination thereof;

wherein the Fe alloy metal has a compatible CTE of from about 10 ppm ° $C.^{-1}$ to about 21 ppm ° $C.^{-1}$ and the spinel ceramic has a compatible CTE of from about 6 ppm ° $C.^{-1}$ to about 11 ppm ° $C.^{-1}$;

(2) manufacturing by an infiltration process a child metal insert casting comprising the compatible Fe alloy metal and the spinel ceramic; and (3) placing the resultant child insert casting into a mother holding casting for specific design and locations using mechanical fixing chaplets before final Fe alloy metal pouring and solidification of a product.

Aspect 2 relates to Aspect 1, wherein the child metal insert consists of a metal matrix of similar characteristics of chemistry, metallurgy and physical appearance as the mother holding casting, such as most steels (0.0-2.2% C) and irons (>2.2% C).

Aspect 3 relates to any one of Aspects 1-2, wherein the spinel ceramic materials and the Fe alloy metal produce a wetting contact angle (θ)<90° and cast metal flow ranges from about 15 in/s to about 60 in/s.

Aspect 4 relates to any one of Aspects 1-3, wherein the spinel ceramic and the Fe alloy metal produce an interface between 1-10 nm to 50-500 μm.

Aspect 5 relates to any one of Aspects 1-4, where the spinel ceramic has (i) a coefficient thermal expansion (CTE-SCP) of from about 60% to about 70% of the CTE of the Fe alloy matrix (CTE-FEAM) or (ii) a CTE-SCP of from about 5% to about 10% of the CTE-FEAM.

Aspect 6 relates to any one of Aspects 1-5, wherein the ceramic material includes a spinel ceramic having a thermal conductivity of from about 20 W/kK to about 55 W/mK, a flexural strength >2500 $Kg/cm^2$, and an enthalpy of formation of from about 25 kJ/mol to about 200 kJ/mol.

Aspect 7 relates to any one of Aspects 1-6, wherein the child metal insert comprises: (i) about 5% by volume to about 60% by volume of the spinel ceramic, (ii) from about 30% by volume to about 40% by volume of the spinel ceramic, or (ii) about 50% by volume of the spinel ceramic.

Aspect 8 relates any one of Aspects 1-7, wherein the spinel ceramic has a size of: (i) from about 25 nm to about 150 nm, (ii) from about 50 μm to about 500 μm, (iii) from about 1 mm to about 10 mm, (iv) or a combination thereof.

Aspect 9 relates to any one of Aspects 1-8, wherein the spinel ceramic is produced by a fusion process, a sintering process, or naturally as obtained from a mine.

Aspect 10 relates to any one of Aspects 1-9, wherein the spinel ceramic is an aluminum spinel, an iron spinel, a chromium spinel, a cobalt spinel, a vanadium spinel, a mineral having a spinel structure, or a combination thereof.

Aspect 11 relates to any one of Aspects 1-10, wherein the mother holding casting comprises a single casting fill rate of about 1 $dm^3/s$ to about 2 $dm^3/s$.

Aspect 12 relates to any one of Aspects 1-11, wherein the mother holding casting comprises a full system fill rate of about 3 $dm^3/s$ to about 6 $dm^3/s$.

Aspect 13 relates to any one of Aspects 1-12, wherein a thermal gradient in the xy-plane for the child insert in the mother holding casting is not more than about 25° C./m.

Aspect 14 relates to the wear resistant mining casting material obtained by any one of the methods of Aspects 1-13.

CITED INFORMATION

Information disclosed here is hereby incorporated by reference, including the subject matter of U.S. Provisional Patent Application No. 63/121,449, filed on Dec. 4, 2020. If an incorporated term conflicts with the meaning of a term disclosed herein, the meaning of the term disclosed herein controls.

[1] Ansell, G., *Oxide Dispersion Strengthening*, G. Ansel, et al., Editors, Gordon and Breach, New York (1968), p 61.

[2] Roberts et al. J.I.S.I. (1968) (206): 375-384.

[3] Grant NJ In: *Frontiers in materials technologies*. Elsevier, New York, 1985, p 125.

[4] Baier et al., Adhesion: *Mechanisms That Assist or Impede It*, Science (1968) 162(3860): 1360-1368.

[5] Jangehud et al. In: Proc. 21st Biennial Conf. on Carbon, Buffalo, NY, Jun. 13-18, 1993.

[6] Chawla et al. In: *High performance composites: commonalty of phenomena. TMS, Warrendale, P A,* 1994, p 207.

[7] Aguilar-Santillan, J. *Wetting of alumina and spinel single crystals by molten aluminum*, PhD diss., University of Alabama, (2004). Available from ProQuest Dissertations Publishing (UMI No. 3190074).

[8] Robert J. Naumann: Introduction to the Physics and Chemistry of Materials CRC Press, 2008, ISBN 978-1-4200-6134-5.

[9] H-J Meyer: Festkörperchemie in: H-J Meyer (ed.), Riedel Moderne Anorganische Chemie, Walter de Gruyter, 2012, ISBN 978-3-11-024900-2.

[10] Ernst, W. G. (1969). Earth Materials (Print ed.). Englewood Cliffs, NJ: Prentice-Hall. p. 58.

[11] Spinel Group at mindat.org (viz., www.mindat.org/min-29156.html, accessed on Dec. 2, 2020).

[12] American Elements, Manganese Cobalt Oxide, Spinel Powder.

The invention claimed is:

1. A casting method of producing a wear resistant mining casting material, said method comprising:

(1) selecting an Fe alloy metal and a spinel ceramic each having a Coefficient of Thermal Expansion (CTE), a wetting contact angle (WCA), or a combination thereof;

wherein the Fe alloy metal has a CTE of from about 10 ppm° C.$^{-1}$ to about 21 ppm° C.$^{-1}$ and the spinel ceramic has a CTE of from about 6 ppm° C.$^{-1}$ to about 11 ppm° C.$^{-1}$; and wherein the Fe alloy metal and the spinel ceramic have a WCA of <90°;

(2) manufacturing by an infiltration process a child metal insert casting comprising the compatible Fe alloy metal and the spinel ceramic; and (3) placing the resultant child insert casting into a mother holding casting for specific design and locations using mechanical fixing chaplets before final Fe alloy metal pouring and solidification of a product.

2. The method of claim 1, wherein the child metal insert consists of a metal matrix having a carbon content of from 0% to 2.2%.

3. The method of claim 1, wherein a cast metal flow ranges from about 15 in/s to about 60 in/s.

4. The method of claim 1, wherein the spinel ceramic and the Fe alloy metal produce an interface between 1 nm to 500 μm.

5. The method of claim 1, wherein the spinel ceramic has CTE of from about 6 ppm° C.$^{-1}$ to about 10 ppm° C.$^{-1}$.

6. The method of claim 1, wherein the spinel ceramic has a thermal conductivity of from about 20 W/kK to about 55 W/mK, a flexural strength >2500 Kg/cm$^2$, and an enthalpy of formation of from about 25 kJ/mol to about 200 kJ/mol.

7. The method of claim 6, wherein the child metal insert comprises: (i) about 5% by volume to about 60% by volume of the spinel ceramic.

8. The method of claim 6, wherein the spinel ceramic has a size of from about 25 nm to about 150 nm.

9. The method of claim 6, wherein the spinel ceramic is produced by a fusion process, a sintering process, or naturally as obtained from a mine.

10. The method of claim 6, wherein the spinel ceramic is an aluminum spinel, an iron spinel, a chromium spinel, a cobalt spinel, a vanadium spinel, a mineral having a spinel structure, or a combination thereof.

11. The method of claim 1, wherein the mother holding casting comprises a single casting fill rate of about 1 dm$^3$/s to about 2 dm$^3$/s.

12. The method of claim 1, wherein the mother holding casting comprises a full system fill rate of about 3 dm$^3$/s to about 6 dm$^3$/s.

13. The method of claim 1, wherein a thermal gradient in the xy-plane for the child insert in the mother holding casting is not more than about 25° C./m.

* * * * *